US005932851A

United States Patent [19]

Wang

[11] Patent Number: 5,932,851

[45] Date of Patent: Aug. 3, 1999

[54] METHOD FOR TRANSMITTING MESSAGES IN AN ELEVATOR GROUP CONTROL SYSTEM

[75] Inventor: Kwang Sig Wang, Kyongsangnam-Do, Rep. of Korea

[73] Assignee: LG Industrial Systems Co., Ltd., Seoul, Rep. of Korea

[21] Appl. No.: 08/953,438

[22] Filed: Oct. 17, 1997

[30] Foreign Application Priority Data

Oct. 17, 1996 [KR] Rep. of Korea ..... 96-46449

[51] Int. Cl.[6] ..... B66B 1/28

[52] U.S. Cl. ..... 187/247; 187/391

[58] Field of Search ..... 187/247, 248, 187/391, 393, 380

[56] References Cited

U.S. PATENT DOCUMENTS 3,851,734 12/1974 Sackin ..... 187/29 R 5,019,960 5/1991 Ando et al. ..... 364/132

5,202,540 4/1993 Auer et al. ..... 187/248

5,387,769 2/1995 Kupersmith et al. ..... 187/248

*Primary Examiner*—Robert E. Nappi

[57] ABSTRACT

The method for transmitting messages in an elevator communication system selects a set of elevator cars from a plurality of elevator cars in the elevator system, and compares present data for the selected set of elevator cars with data stored in a single table. The present data which differs from the data stored in the table is designated as changed or differing data. This differing data is transmitted to the plurality of elevator cars. Along with the differing data, retransmission data ordered according to the priority associated therewith is also transmitted along with the differing data. In this manner, a group communication controller controls the communication for several elevator cars.

10 Claims, 9 Drawing Sheets

FIG. 3
(PRIOR ART)

| | |
|---|---|
| DATA NO. 0 | DATA 0 |
| DATA NO. 1 | DATA 1 |
| ⋮ | |
| DATA NO. K | DATA K |

FIG. 4
(PRIOR ART)

| TRANSMITTING DATA STORAGE TABLE | |
|---|---|
| DATA NO. 0 | DATA 0 |
| DATA NO. 1 | DATA 1 |
| ⋮ | |
| DATA NO. N | DATA N |

FIG. 13

| CONTENTS | ELEVATOR CAR 1 | ELEVATOR CAR 2 |
|---|---|---|
| ELEVATOR NUMBER | 1 | 2 |
| NUMBER OF THE DATA | 4 | 4 |
| NUMBER OF THE RETRANSMISSION DATA | 4 | 2 |

| | |
|---|---|
| 1 | 2 |
| 4 | 4 |
| 4 | 2 |
| ELEVATOR CAR 1 DATA 1 | ELEVATOR CAR 1 DATA 2 |
| ELEVATOR CAR 1 DATA 3 | ELEVATOR CAR 1 DATA 4 |
| ELEVATOR CAR 2 DATA 1 | ELEVATOR CAR 2 DATA 2 |
| ELEVATOR CAR 2 DATA 3 | ELEVATOR CAR 2 DATA 4 |
| ELEVATOR CAR 1 RETRANSMISSION DATA 1 | ELEVATOR CAR 1 RETRANSMISSION DATA 2 |
| ELEVATOR CAR 1 RETRANSMISSION DATA 3 | ELEVATOR CAR 1 RETRANSMISSION DATA 4 |
| ELEVATOR CAR 2 RETRANSMISSION DATA 1 | ELEVATOR CAR 2 RETRANSMISSION DATA 2 |

METHOD FOR TRANSMITTING MESSAGES IN AN ELEVATOR GROUP CONTROL SYSTEM

BACKGROUND OF THE INVENTION

1. Field of the Invention

The present invention is related to a method for transmitting messages in an elevator group control system.

2. Description of the Prior Art

In an elevator communication system, all communication data originating from a separate group controller is not transmitted to a plurality of elevator controllers at almost the same time. If all communication data were transmitted from the group controller to the elevator controllers within a predetermined period, this large communication burden could cause a jam in the processing of the communication data. Accordingly, transmission efficiency is regarded as a major factor in the quality of such a control apparatus.

FIG. 1 is a simplified block diagram of a conventional elevator communication system.

Referring to FIG. 1, the elevator communication system consists of a plurality of elevator controllers 12A–12K, each associated with a floor of a building, to execute elevator-related signaling and control the execution of necessary operations; group controller 11 to execute group-related signaling and dispatch functions; and a common network NET to associate the elevator controllers 12A–12K and the group controller 11.

FIG. 2 is a block diagram illustrating a communication control circuit in the conventional elevator communication system.

As illustrated in FIG. 2, employed in the group controller 11 illustrated in FIG. 1 are a plurality of group communication controllers 21A–21K. A plurality of elevator communication controllers 22A–22K are employed in elevator controllers 12A–12K, respectively, and communicate with the group communication controllers 21A–21K via exclusive communication lines in a one-to-one parallel fashion.

The operation of the elevator communication system described as above, will be explained with reference to FIGS. 3 through 6.

If a passenger who is standing on the $8^{th}$ floor selects a hall call such as "down" via a control panel (not shown) associated with one of the elevator controllers 12A–12K the corresponding elevator communication controller 22A–22K recognizes an inputting-signal of hall call and transmits the data to the corresponding group communication controller 21A–21K.

Next, after a predetermined time, the group communication controller 21A–21K retransmits the transmitted data to the corresponding elevator communication controller 22A–22K to execute the operation as ordered. This confirms the correctness of the transmitted data.

In the retransmission operation, the communication data, which is data transmitted from the group communication controller 21A–21K to elevator communication controller 22A–22K or vice versa, consists of 1) data number and 2) associated data. FIG. 3 illustrates a table of communication data stored at the group controller 11 by each group communication controller 21A–21K for a respective elevator communication controller 22A–22K. The data number represents an index indicating a data record for the data transmission, while the region labeled data is where the actual data is stored. For example, in case that a data number "3" is assigned to the transmission data of calling the elevator car from the $1^{st}$ to the $8^{th}$ floor, the elevator communication controller 22A–22K executes a recording operation and records "3" as the data number in FIG. 3 and "the hall call from 1 to 8 floor" in the data region in FIG. 3. Subsequently, the group communication controllers 21A–21K for the first floor outputs the communication data as retransmission data to the corresponding elevator communication controller 22A–22K.

FIG. 4 illustrates a transmission data storage table stored at each group communication controller 21A–21K with respect to the associated elevator communication controller 22A–22K in the conventional communication system. This table is used to transmit changed data after comparing present data with previous data stored in the group communication controller 21A–21K.

FIG. 5 is a flow chart showing how transmission data, data for transmission to one of the elevator communication controllers 22A–22K from one of the group communication controllers 21A–21K, is created by one of the group communication controllers 21A–21K.

Referring to FIG. 5, the retransmission data is determined in step S1 by one of the group communication controllers 21A–21K, and the data number is initialized by "1" in step S2 (the number "1" is an index indicating a record of the transmission data storage table as illustrated in FIG. 4). For instance, if the data number is "2", a comparative data is "data 2" of the table illustrated in FIG. 4.

Next, a test S3 is performed to determine if any changed data is created with respect to all communication data; namely, determine whether the table of FIG. 3 includes new data. If the test S3 is affirmative, the overall program is returned to a transfer point T1. But if test S3 is negative, a test S4 is executed to determine if the communication data fills the communication data table of FIG. 3. That is to say, if a communication buffer in the group communication controller 21A, 22B, . . . or 21K for the record is not fully filled, the program is returned through a transfer point T2.

But if the test S4 is negative, a test S5 is executed to check if the present data is identical to the data recorded in the transmission table. If not, the relative data number and the actual data are recorded on the record region in the transmission table of FIG. 4 which will be transmitted in step S6. Subsequently, the data number is increased by "1" to process the next data in step S7. But if the test S5 is negative, the step S7 will also be executed.

FIG. 6 is a flow chart showing how the retransmission data is created in the conventional control apparatus.

The flow chart illustrated in FIG. 6 is a subroutine for determining the retransmission data in step S1 of FIG. 5. In FIG. 6, a test ST1 determines if the retransmission data number stored in the group controller 11 is a maximum data number, i.e., if the number is bigger than the largest possible data number for the transmission data storage table of FIG. 4. If the test is affirmative, the retransmission data number is initialized to 1 in step ST2. However, if the test is negative, the data of the transmission data storage table indicated by the retransmission data number is recorded on the data record to be transmitted in step ST3. Subsequently, the data number is increased by "1" in the next data step ST4.

According to the conventional process for creating the retransmission data as described above, it is noted that if the maximum data number recorded on the transmission table is 48 and the transmission period for the data record to be transmitted is 32 ms, the maximum time it takes to retransmit the data record, wherein the data record has already been transmitted, is 1,536 ms (T=48×32 ms).

The number of the data which each of the group communication controllers 21A–21K transmits to the corresponding elevator communication controller 22A–22K is predetermined as 8. So, when the number of the data to be transmitted is 4, another 4 data should be added thereto for transmission.

For that reason, there are drawbacks that the transmission time is delayed, thereby putting a large burden on communication processing.

Further, in case that the elevator cars connected to the group controller 11 are 5 and the communication period is 32 ms, the time it takes to transmit the record for 5 elevator cars is 160 ms (T–5×32 ms), since the group controller 11 has been communicated with each elevator car via the common network NET.

Accordingly, in the conventional elevator communication system, when the records are transmitted, an unnecessary region, where no information is recorded, is also transmitted together because the record length is already predetermined. In the example above, another four records were added to reach the predetermined number of records (i.e., eight), even though only four records needed to be sent. Further, if several elevator cars need to transmit the records at almost the same time, there is a drawback of a heavy burden in the communication process since each elevator car does not recognize the present operations of each elevator controller.

SUMMARY OF THE INVENTION

Therefore, the present invention has been devised to solve the problems involved in the prior art.

These and other objects are achieved by providing a method for transmitting messages in an elevator communication system, comprising: a) selecting, using a group communication controller, a set of elevator cars from a plurality of elevator cars in said elevator communication system; b) comparing present data for said selected set of elevator cars with data in a single table stored by said group communication controller to determine differing data, said differing data being said present data which differs from said data in said single table; and c) transmitting said differing data to said plurality of elevator cars.

BRIEF DESCRIPTION OF THE DRAWINGS

The above object and other features of the present invention will become more apparent by describing the preferred embodiments thereof with reference to the accompanying drawings, in which:

FIG. 3. is a communication data table in a conventional elevator communication system.

FIG. 4 is a transmission data storage table in a conventional elevator communication system.

FIG. 13 is an example of communication data table created for the case of an operation of two elevator cars.

DETAILED DESCRIPTION OF THE PREFERRED EMBODIMENTS

The preferred embodiments of the present invention will now be explained with reference to the accompany drawings.

Figure 1:
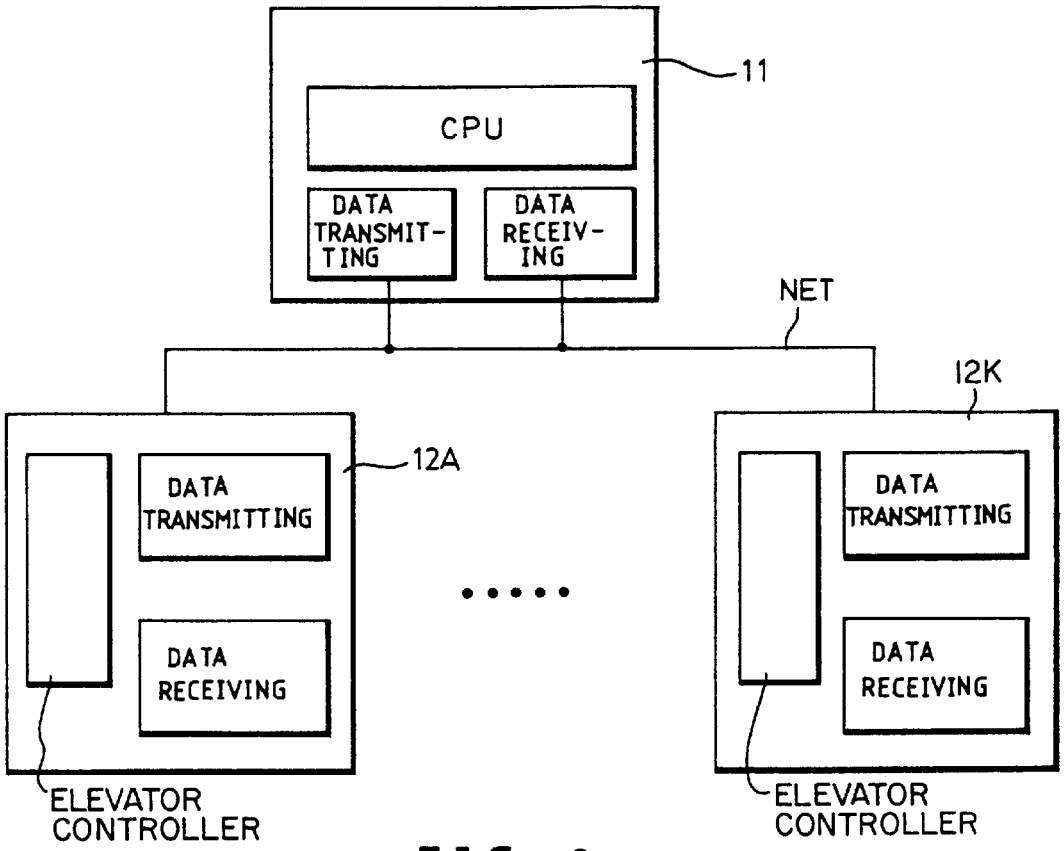
FIG. 1 (PRIOR ART)
FIG. 1 is a simplified block diagram of a conventional elevator communication system.
Figure 2:
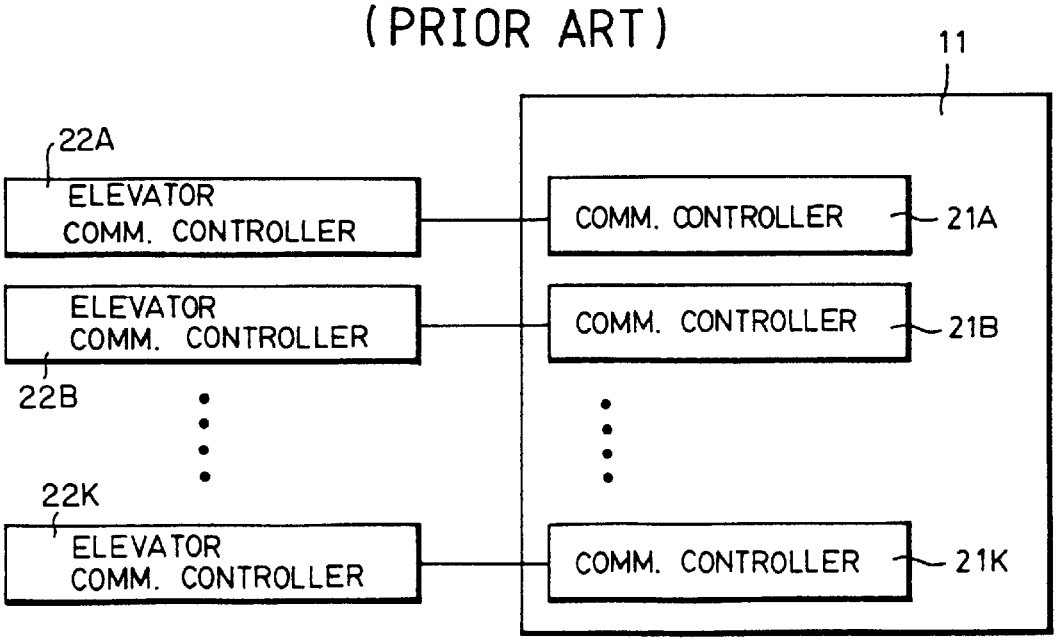
FIG. 2 (PRIOR ART)
FIG. 2 is a simplified block diagram illustrating a communication control circuit in a conventional elevator communication system.
Figure 5:
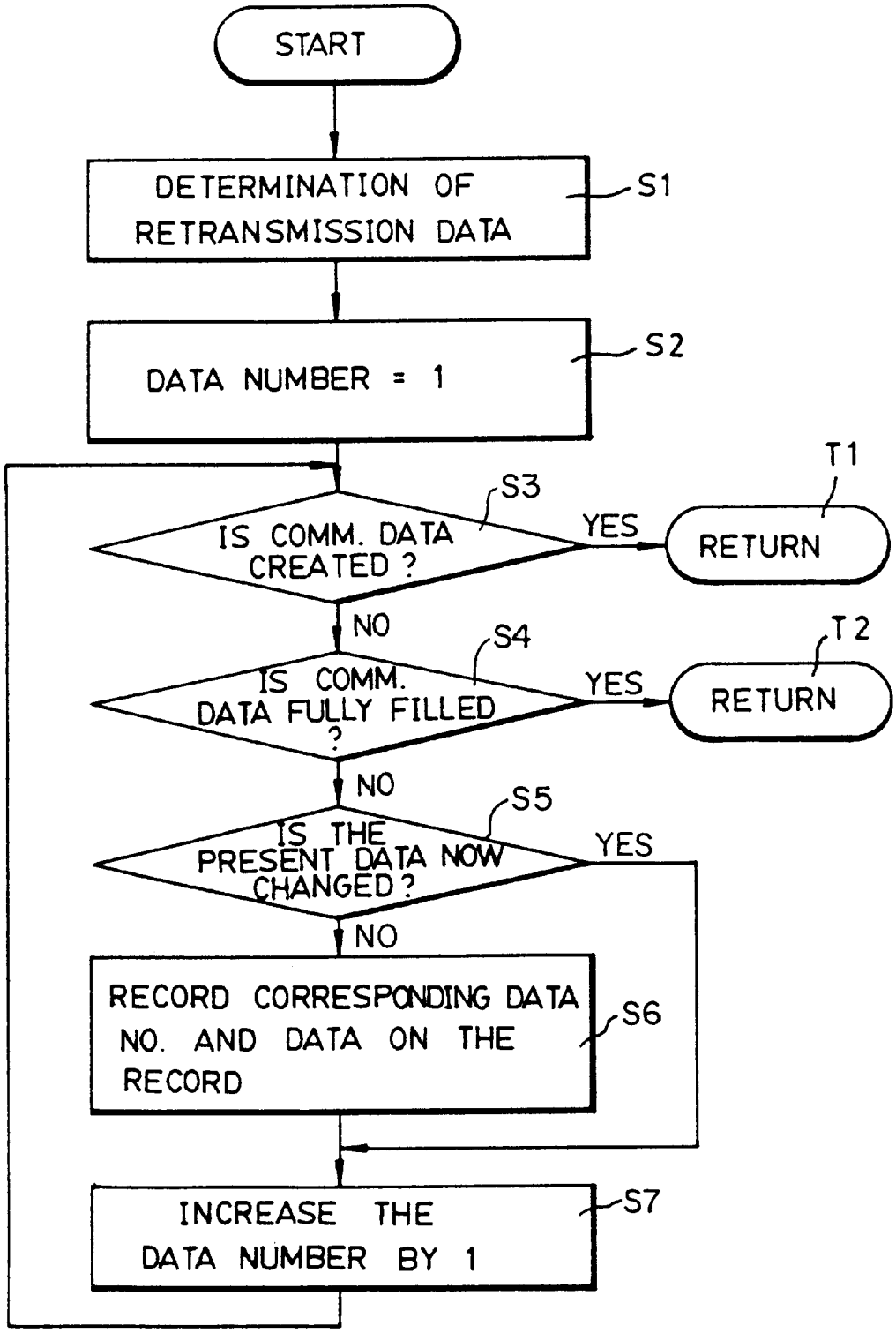
FIG. 5 (PRIOR ART)
FIG. 5 is a flow chart showing how a transmission is performed in a conventional elevator communication system.
Figure 6:
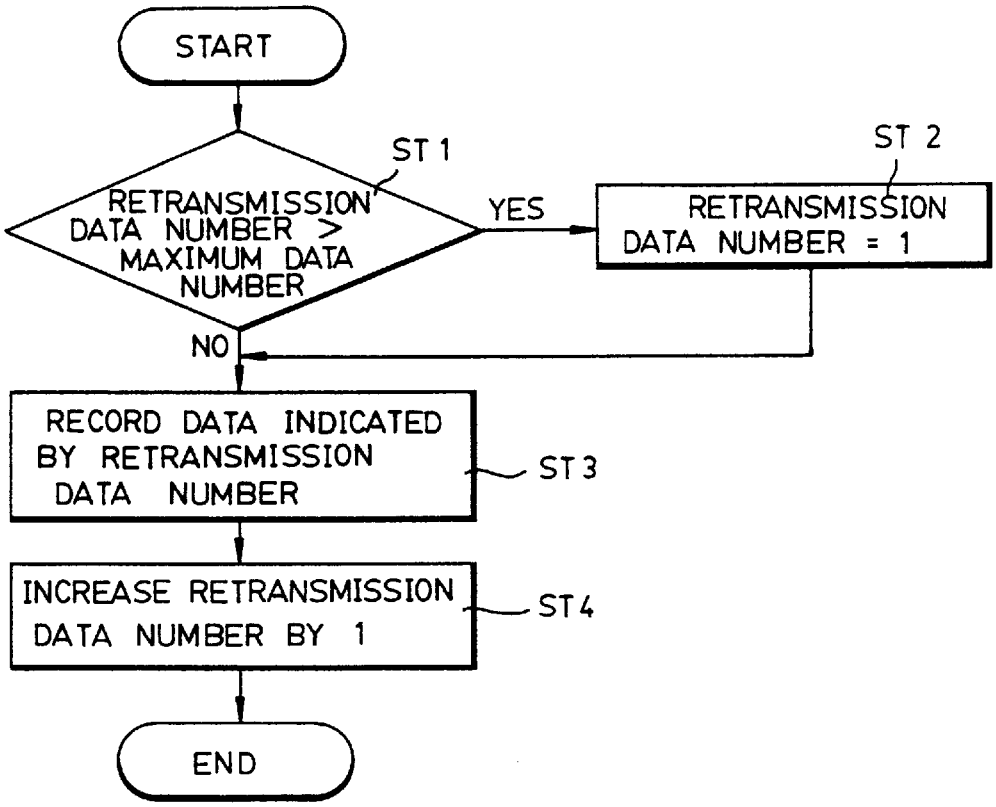
FIG. 6 (PRIOR ART)
FIG. 6 is a flow chart showing how transmission data is created in a conventional elevator communication system.
Figure 7:
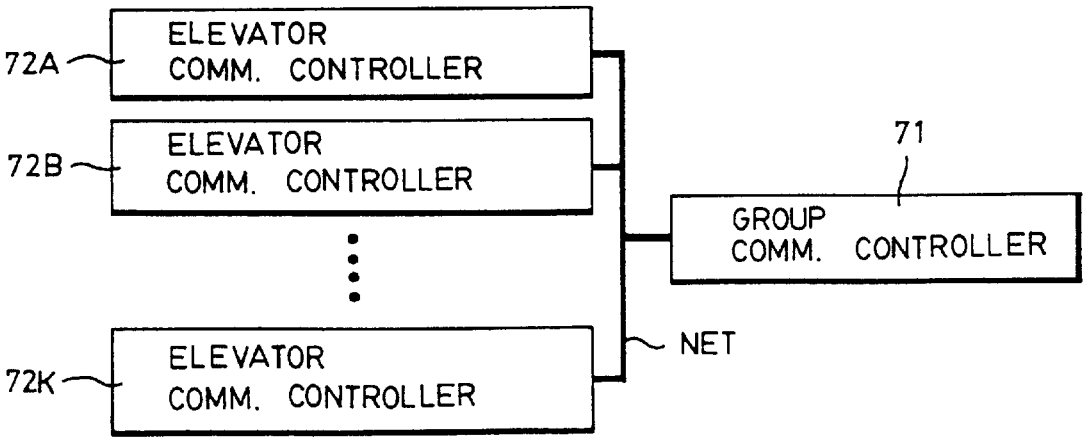
FIG. 7 is a simplified block diagram of an elevator communication system applying a method for transmitting messages according to the present invention.

FIG. 7 is a simplified block diagram of an elevator communication system applying a method for transmitting messages according to the present invention.

Referring to FIG. 7, a plurality of elevator communication controllers 72A–72K, provided in each elevator controller, are associated with a common bus line of a group communication controller 71, provided in a separate group controller. Accordingly, the group communication controller 71 circularly selects one of the elevator communication controllers 72A–72K within a predetermined period and in a predetermined order.

Figure 8:
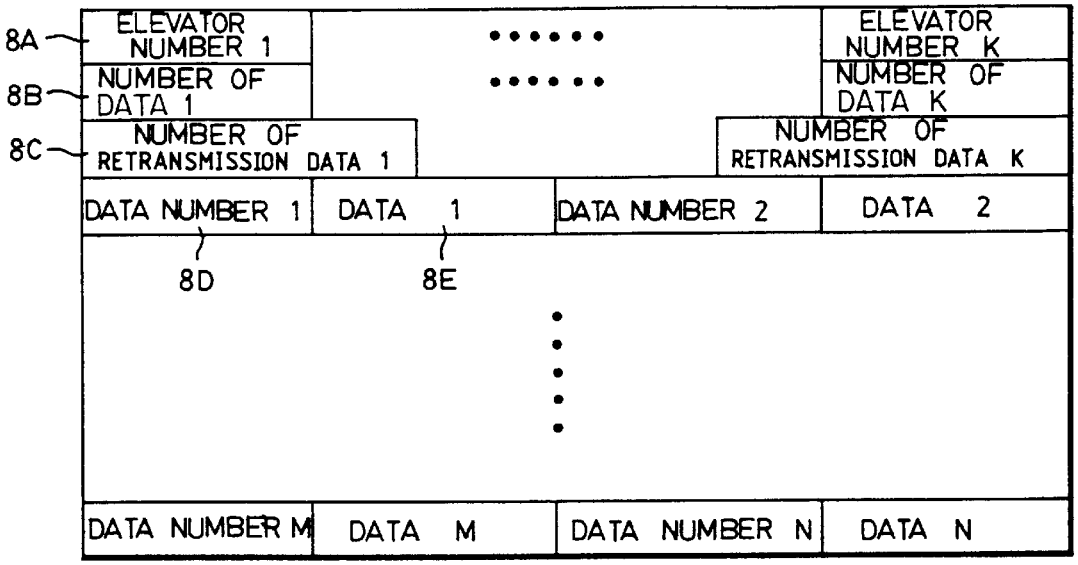
FIG. 8 is a communication data table according to the present invention.

FIG. 8 is a communication data table which is used for transmitting messages created by the group communication controller 71. This table stores all new messages received from or to be transmitted to the elevator communication controllers 72A–72K.

As shown, the communication data includes an elevator number 8A, the number of data 8B, and the number of retransmission data 8C. Such data combinations can be recorded with maximum numbers predetermined thereto, since the corresponding elevator messages created by the group communication controller 71 are stored in one table and can be transmitted to the elevator communication controllers 72A–72K. The elevator number 8A represents an identifying number given to an elevator car which is transmitting a message such as the transmission data, the number of data 8B represents the number of data for the corresponding elevators from a data region which will be described hereinafter, and the number of the retransmission data 8C represents the number of retransmission data for the corresponding elevator cars recorded in a data region which will be described hereinafter. Accordingly, if the data number of all elevator cars are added to the number of retransmission data, the number N of the record will be obtained. Further, the data number 8D represents an index for identifying the data while the data 8E represents a region where the data, which the group controller 71 transmits, are recorded. Therefore, the total number of the records is obtained by summing the total number of the data and the total number of the retransmission data.

FIG. 13 is an example of a communication data table used in the case where two elevators are operated.

Figure 9:
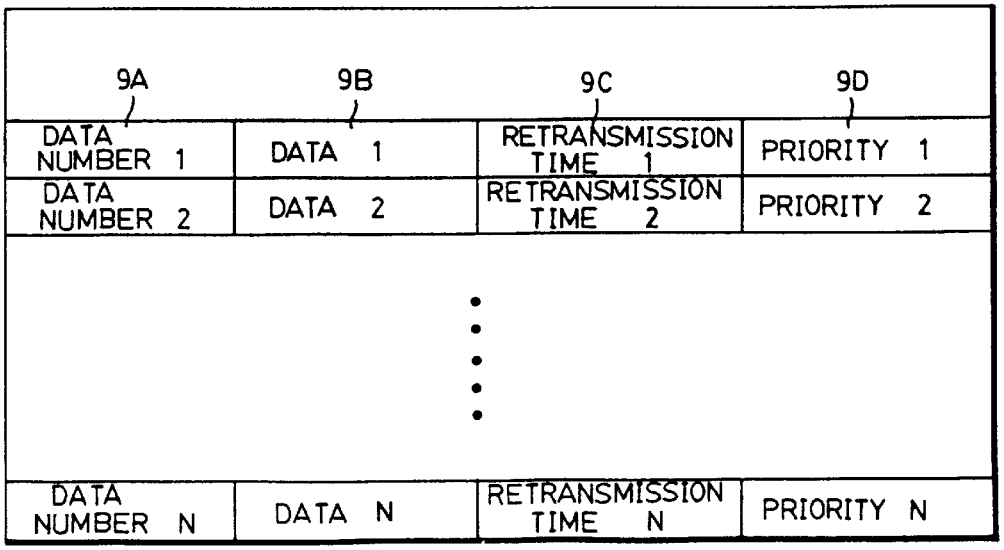
FIG. 9 is a transmission data storage table according to the present invention.

FIG. 9 illustrates a transmission data storage table according to the present invention. Such a table is used as a storage region by the group communication controller 71 for transmission data in the communication system, and is used to decrease the network load by minimizing the number of the transmission data. Namely, the group communication controller 71 compares the present data to the data previously stored in the communication data table of FIG. 8, and if the present data differs from the previously stored data, the present data is stored in the transmission data table of FIG. 9.

In FIG. 9, a data number region 9A stores an index for determining a data meaning, the transmission data region 9B is a storage region for the transmission data, the retransmission time region 9C is a storage region of the number of the corresponding transmitted data within the predetermined period, and a priority region 9D is a region storing the priority for retransmitting the data. As a result, the highest priority data is retransmitted first. If the same priority occurs, the data which the group communication controller 71 attempted to transmit the greatest number of times is given higher priority.

Figure 10:
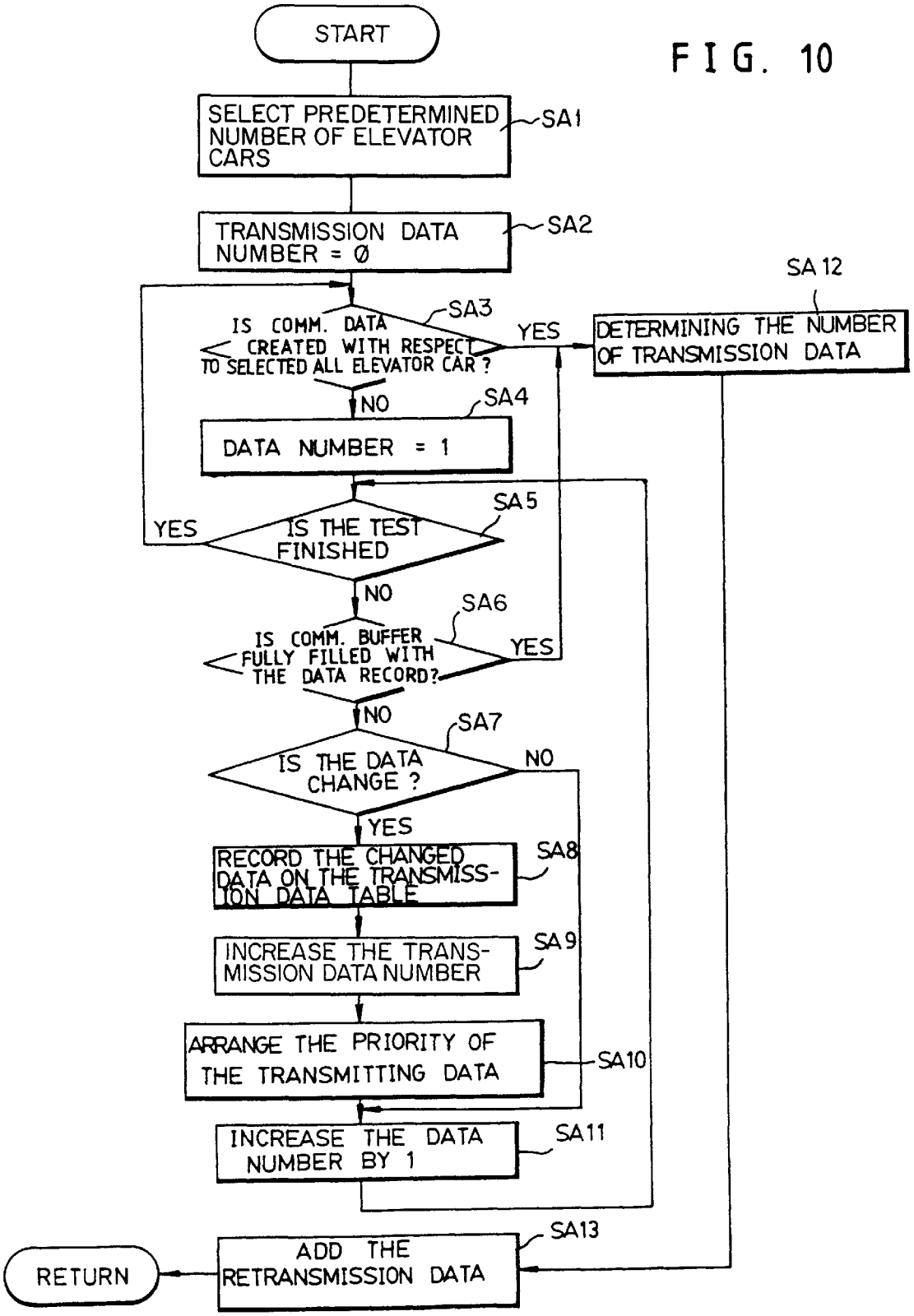
FIG. 10 is a flow chart illustrating how communication data is created in accordance with the present invention.

Now, the routine illustrated in the flow chart of FIG. 10 will be explained to show how the communication data is created by the group communication controller 71.

First, initialization is caused by power-on-reset and the group communication controller 71 circularly selects the elevator number for each elevator communication controller 72A–72K within a predetermined period and in a predetermined order in step SA1. More specifically, a predetermined number of elevator cars are selected in a predetermined order. Thus, the group communication controller 71 circularly selects one of the elevator car numbers one by one. For instance, assume 5 elevator cars are associated with the group communication controller 71, which are numbered as 1, 2, 3, 4 and 5, and the messages for three cars, e.g., cars 1, 2 and 3 are selected in step SA1 with respect to a first communication. In a similar manner, messages for the elevator cars 4, 5 and 1 will be selected for a in the second communication, messages for the elevator cars 2, 3 and 4 will be selected for a third communication, etc. Next, the number of the retransmission data recorded in the transmission data table (FIG. 9) is set to "0" in step SA2. A test SA3 determines if the communication data for each of the elevator cars selected in step SA1 has been tested for transmission. The data number set in step SA4 is used as a counter of the number of elevator cars tested. When the data number exceeds the predetermined number of elevator cars selected in step SA1, step SA3 determines that all the selected elevator cars have been tested. If the test is affirmative, step SA12 will be executed to determine the number of data for transmission. As discussed in detail below, the number of data for transmission will equal the transmission data number determined in step SA9.

On the other hand, if test SA3 is negative, then initialization of the data number indicating the data number of a record in the transmission data storage table illustrated in FIG. 9, is set as "1" in step SA4.

Next, it is determined whether data number is greater than the predetermined number of elevator cars selected in step SA1. If test SA5 is affirmative, the routine is returned to step SA3. On the other hand, if test SA5 is negative, a test SA6 will be executed to determine if a communication buffer (not shown) storing the transmission data is full. This test compares the transmission data number (see step SA9) to the storage capacity of the communication buffer. If the transmission data number is greater than the storage capacity of the communication buffer, the step SA6 determines that the communication buffer is full. If the test is affirmative, step SA12 will be executed because no more data can be recorded. But if the test SA6 is negative, a test SA7 will be executed.

Test SA7 determines if the present data has changed by comparing the present data with the data stored in the communication data table of FIG. 8. If the data has not changed, step SA11 is executed directly. But if test SA7 is affirmative, that is, the data has changed, it shows that there is a need for communication because the communication data being processed in the group communication controller 71 differs from the data previously stored in the communication data table.

Accordingly, the corresponding data number and the data are recorded in a data region of FIG. 8, and this changed data is also recorded on the transmission data table illustrated in FIG. 9 in step SA8. After step SA8, the number of the transmission data is increased by "1."

Subsequently, the priority for the data stored in the transmission data table of FIG. 9 is arranged in step SA10 as described in detail below, and the number of the data is increased by 1. Next, processing returns to step SA5 and continuously executes steps SA3 through SA11 repeatedly.

Accordingly, as a result of the repeated steps, the test SA3 determines if the communication data is created with respect to all selected elevator cars. If the test is affirmative, a step SA12 is executed to record the number of the transmission data on the region 8B of communication data table illustrated in FIG. 8, and the retransmission data is additionally added in step SA13 and the routine returns.

Figure 11:
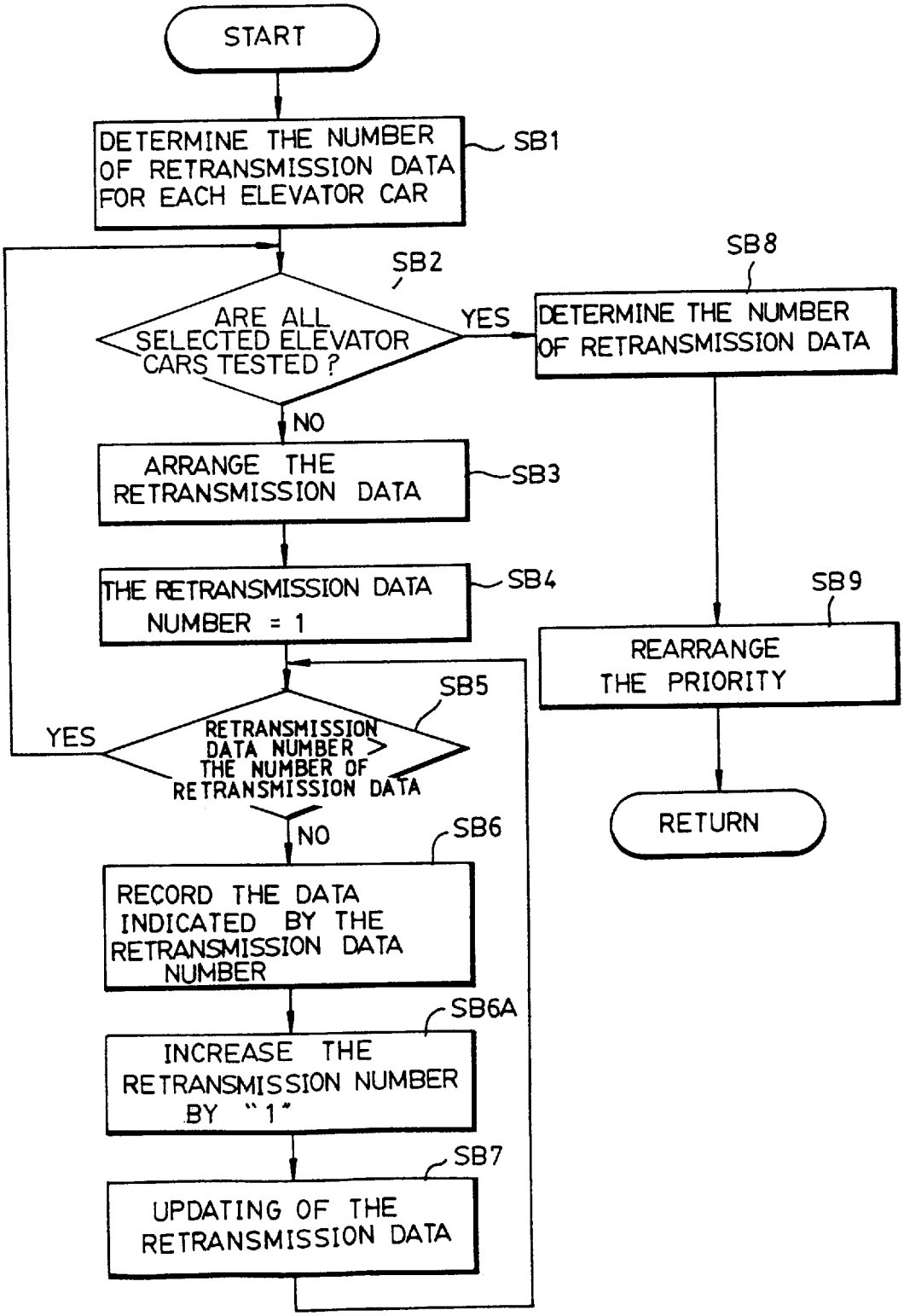
FIG. 11 is a flow chart illustrating how the retransmission data is created in accordance with the present invention.

The retransmission data is determined by executing a subroutine illustrated in FIG. 11.

First, in step SB1, the number of retransmission data is determined for the selected elevator cars in accordance with the flowchart of FIG. 12 described in detail below. At this time, the priority of the data will be determined as below.

Priority 1: previously transmitted data

Priority 2: transmitted data within the predetermined period

Priority 3: non-transmitted data within the predetermined period

Priority 4: retransmitted data within the predetermined period

Priority 100: transmission data at present

Figure 12:
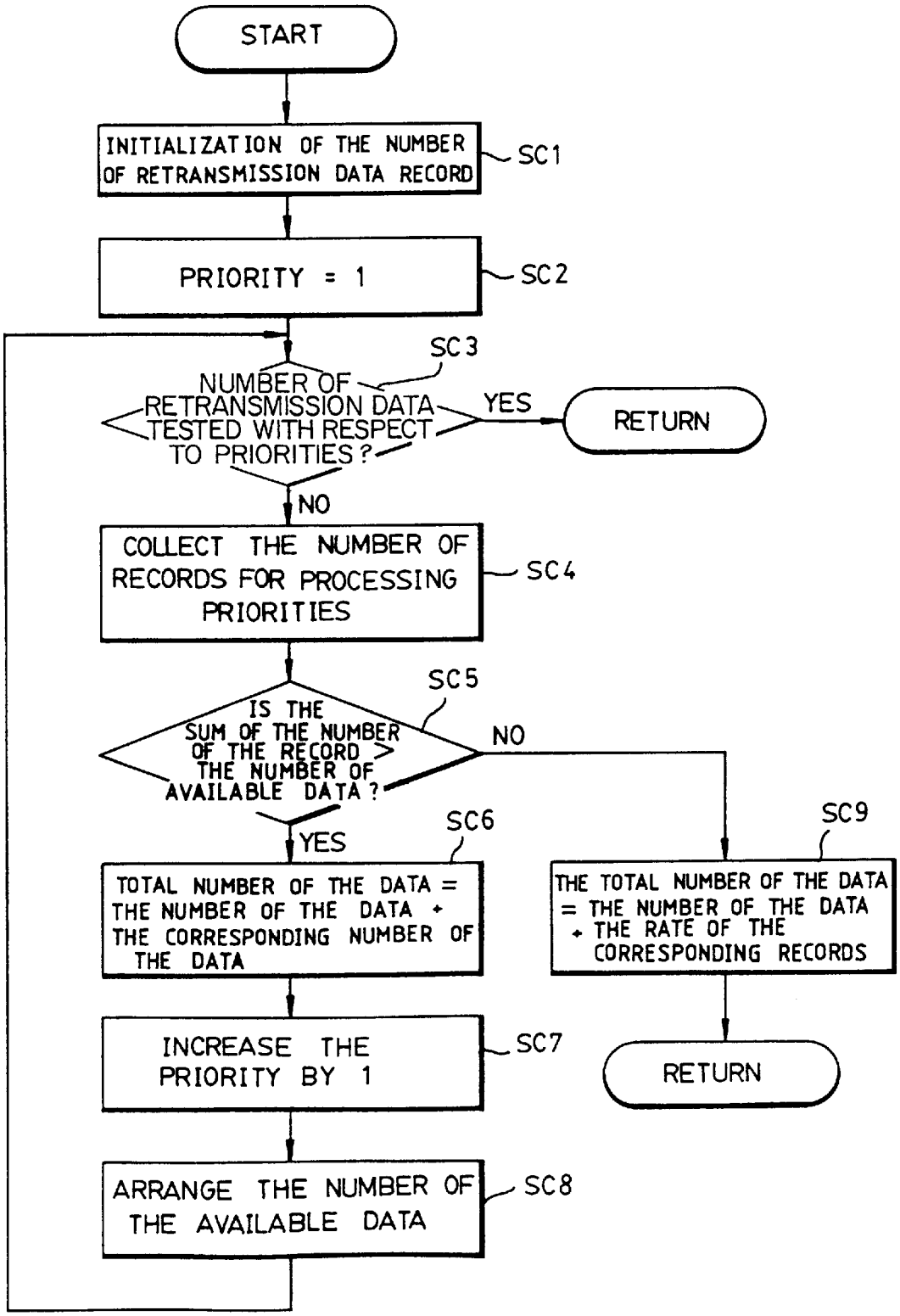
FIG. 12 is a flow chart illustrating how the number of retransmission records is determined in accordance with the present invention.

If the number of the retransmission data for each elevator car is determined by the routine illustrated in FIG. 12, a test SB2 determines if the number of retransmission data for each selected elevator car has been tested via steps SB3–SB7. If so, the number of the retransmission data for each elevator car is recorded on the region 8C as the number of the retransmission data in the communication data table illustrated in FIG. 8 in step SB8. Then a step SB9 is executed to arrange the retransmission data according to priority such that the priority 100 of the present transmission data is changed to the priority 1 and the retransmission is executed with the highest priority retransmission data in the next period. In this case, the elevator cars processed here are limited to the selected elevator cars selected in step SA1 illustrated in FIG. 10.

If the test in step SB2 is negative, the retransmission data is arranged based on the priority of the transmission data storage table shown in FIG. 9 for processing elevator cars in step SB3, and the retransmission data number is initialized to "1" in step SB4. Next, a test SB5 determines if the retransmission data number is greater than the number of the retransmission data, which is obtained in step SB1 illustrated in FIG. 11, for the elevator car undergoing test. At this time, if the test is affirmative, the program is returned to test SB2 and steps SB2 through SB5 are repeated with respect to the next elevator car.

But if test SB5 is negative, the data indicated by the retransmission data number is recorded in the retransmission data record in step SB6 and the retransmission number is increased by "1" in step SB6A. At this stage, the retransmission data having the highest priority is recorded on the data record in step SB7 since the transmission data table is updated by the highest priority in accordance with the execution of step SB3.

Next, the priority for the retransmission data forming the data record in step SB7 is changed to the priority 4, representing the retransmitted data within the predetermined period as the selected data record which can be transmitted together with the communication data so that the data record is not selected when the next communication data is transmitted.

The number of the retransmission data record is obtained by executing a subroutine illustrated in FIG. 12.

Referring to FIG. 12, first, the number of the available retransmission data record is initialized in step SC1, and the priority is also initialized to the priority 1 in step SC2. Next, a test SC3 determines if a number of the retransmission data has been tested with respect to all priorities. Namely, a predetermined amount of data is transmitted by the group communication controller 71. This predetermined amount less the amount of transmission data determined with respect to FIG. 10 gives the space left for the retransmission data. If the test in step SC3 is affirmative, the program is returned. But if test SC3 is negative, the number of records for the priority being processed are collected in step SC4, wherein the priority of the transmission data storage table illustrated in FIG. 9 is used.

Subsequently, a test SC5 determines if the number of the available data is larger than a sum of the number of the transmission data records of the corresponding priority number. If the test is affirmative, the number of the data records, which is identical to the processing priority in accordance with the execution of searching the transmission data storage table for selected elevator cars in step SA1 illustrated in FIG. 10, is determined as the number of the data for the corresponding elevators. Thus, the total number of the data can be obtained by summing the number of the data and the corresponding records in step SC6.

Next, the priority is increased by "1" in step SC7, and a value, which is obtained by subtracting the number of the available data record assigned by step SC6 from the number of the available data, is used as the number of new available data.

But if the test SC5 is negative, indicating that the number of the record for the processing priority is bigger than that of the available data, the rate-assignment is executed in accordance with the number of the total data obtained by summing the number of the data and the rate of the corresponding records in step SC9.

For instance, in the case that the number of available retransmission data region is 8 and the selected elevator cars are two elevator cars 1 and 2, the number of the retransmission data record for each elevator car illustrated table 2 will be obtained from the given table 1.

TABLE 1

| Elevator No. | Priority 1 | Priority 2 | Priority 3 |
|---|---|---|---|
| 1 | 3 | 6 | 8 |
| 2 | 2 | 3 | 12 |

TABLE 2

| Elevator No. | Priority 1 | Priority 2 | Priority 3 | Total |
|---|---|---|---|---|
| 1 | 3 | 2 | 0 | 5 |
| 2 | 2 | 1 | 0 | 3 |

Referring to table 2, when the priority 1 is determined, the total number 5 is smaller than the number 8 of the retransmission data region, so assignment will be executed as it is.

Similarly, when the priority 2 is determined, the total number 9 is bigger than the number of the retransmission data region: i.e., 3, so assignment will be executed in accordance with equation (1).

$$\text{elevator 1: } 3\times 6/9=2$$

$$\text{elevator 2: } 3\times 3/9=1 \qquad \ldots \text{ equation (1)}$$

Further, in the case that the number of the records which are available to record on the communication records is 8 and the number of the changed data is 4, only 4 data records are used for the region of the retransmission records.

Accordingly, it is noted that the time it takes to transmit messages having 48 records is 384 ms (32 ms×48/4), while it takes 1,436 ms in the prior art.

Further, assume that the number of the elevator cars associated with the communication system is 5, the communication period is 32 ms, and the data records created from the plurality of elevator cars are circularly transmitted within the predetermined period, for example, 32 ms, and the predetermined order using one data record. In this case, if messages for two elevator cars are transmitted at almost same time, the time it takes to transmit messages of the total 5 of elevator cars is 80 ms (T=32 ms×2.5).

Thus, because of the transmitting method for selecting corresponding elevator circularly, messages for the elevator cars 1 and 2 will be recorded in the data 1, and similarly messages for the cars 3 and 4 in the data 2, messages for the cars 5 and 1 in the data 3, etc.

As described above, the retransmission data record region including the communication data are made of a minimum number of the transmission data after recognizing that the data is changed by causing in each elevator car as well as messages for elevator cars will be transmitted by circularly selecting corresponding elevator in the predetermined order.

Therefore, the transmission speed and capacity are highly increased and the total efficiency in processing communication data is largely improved.

Many modifications and variations of the present invention are possible in light of the above teachings. Therefore, it is to be understood that within the scope of the appended claims, the invention may be practiced otherwise than as specifically described.

I claim:

1. A method for transmitting messages in an elevator communication system, comprising:

a) selecting, using a group communication controller, a set of elevator cars from a plurality of elevator cars in said elevator communication system;

b) comparing present data for said selected set of elevator cars with data in a single table stored by said group communication controller to determine differing data, said differing data being said present data which differs from said data in said single table; and c) transmitting said differing data to said plurality of elevator cars.

2. The method of claim 1, wherein said comparing step comprises:

b1) comparing one of said present data for said selected set of elevator cars with said data in said single communication data table to determine whether said present data qualifies as differing data;

b2) increasing a differing data amount if said present data qualifies as differing data;

b3) determining whether said differing data amount equals a predetermined data transmission amount;

b4) repeating steps b1)–b3) for a next one of said present data for said selected set of elevator cars if said step b3) determines said differing data amount does not equal said predetermined data transmission amount.

3. The method of claim 1, further comprising:

d) determining retransmission data for each of said selected set of elevator cars based on retransmission data and priority data for said retransmission data stored by said group communication controller; and wherein said step c) adds said determined retransmission data to said differing data.

4. The method of claim 3, wherein said step d) comprises:

d1) determining an amount of retransmission data which can be transmitted for each of said selected set of elevator cars based on said retransmission data and said priority data for said retransmission data stored by said group communication controller.

5. The method of claim 3, wherein said step c) orders said differing data and said determined retransmission data for transmission based on said priority data for said determined retransmission data.

6. The method of claim 5, wherein said step c) orders said differing data and said determined retransmission data for transmission in an order of: previously transmitted data, data transmitted within a predetermined period of time, data which has not been transmitted within the predetermined period of time, and the differing data.

7. The method of claim 3, further comprising:

e) storing the differing data in said single table; and f) storing the differing data in a transmission table.

8. The method of claim 7, wherein said step f) stores said determined retransmission data and said priority data for said determined retransmission data in said transmission table.

9. The method of claim 1, further comprising:

d) storing the differing data in said single table; and e) storing the differing data in a transmission table.

10. The method of claim 1, further comprising:

d) repeating steps a)–c) wherein said step a) selects another set of elevator cars such that said plurality of elevator cars are selected in a circular fashion.

* * * * *